US005800082A

United States Patent [19]

Yamasawa

[11] Patent Number: 5,800,082

[45] Date of Patent: Sep. 1, 1998

[54] RECORDING APPARATUS AND RECORDING TEMPERATURE CONTROL METHOD

[75] Inventor: Akira Yamasawa, Ebina, Japan

[73] Assignee: Fuji Xerox Co., Ltd., Tokyo, Japan

[21] Appl. No.: 816,253

[22] Filed: Mar. 13, 1997

[30] Foreign Application Priority Data

Mar. 14, 1996 [JP] Japan ..... 8-057326

[51] Int. Cl.[6] ..... B41J 2/365

[52] U.S. Cl. ..... 400/120.14; 400/54; 347/189

[58] Field of Search ..... 400/54, 74, 120.14, 400/124.13, 124 TC; 347/189

[56] References Cited

U.S. PATENT DOCUMENTS

| | | | |
|---|---|---|---|
| 4,540,295 | 9/1985 | Okunishi | 400/54 |
| 4,653,940 | 3/1987 | Katsukawa | 400/54 |
| 4,791,435 | 12/1988 | Smith et al. | 346/1.1 |
| 4,814,787 | 3/1989 | Doi | 347/189 |
| 4,910,528 | 3/1990 | Firl et al. | 400/54 |
| 4,978,239 | 12/1990 | Alexander et al. | 400/54 |
| 5,051,756 | 9/1991 | Nomura et al. | 347/189 |
| 5,059,044 | 10/1991 | Takaishi | 400/120.14 |
| 5,064,302 | 11/1991 | Tanuma et al. | 400/54 |
| 5,152,619 | 10/1992 | Niikawa et al. | 400/54 |
| 5,662,421 | 9/1997 | Hagiwara | 400/54 |

FOREIGN PATENT DOCUMENTS

| | | | |
|---|---|---|---|
| A 64-38246 | 2/1989 | Japan | 400/54 |
| B2 5-15387 | 3/1993 | Japan | 400/54 |

*Primary Examiner*—Edgar S. Burr
*Assistant Examiner*—Steven S. Kelley
*Attorney, Agent, or Firm*—Oliff & Berridge, PLC

[57] ABSTRACT

A controller receives a signal indicating the temperature of a print head from a head temperature detection thermistor. The controller sets a cooling time for the print head based on a time in which the temperature of the print head increase from a first temperature to a second temperature and an environment temperature detected by an environment temperature detection thermistor. When the temperature of the print head exceeds the second temperature due to excessive heat accumulation therein, printing and movement of the print head are suspended for the cooling time immediately after completion of printing of one or a plurality of bands at a position where the print head is located at that time. Thus, the temperature of the print head is decreased.

18 Claims, 8 Drawing Sheets

RECORDING APPARATUS AND RECORDING TEMPERATURE CONTROL METHOD

BACKGROUND OF THE INVENTION

1. Field of the Invention

The present invention relates to a recording apparatus having a print head for thermally forming print dots, and a recording control method therefor.

2. Description of the Related Art

In a recording apparatus that uses the method of thermally forming print dots on a recording medium, the temperature of a print head may increase excessively due to heat developed in the print head during printing operations, thus affecting the print quality or the print head itself;

In an ink-jet recording apparatus, air bubbles are formed by heating ink, and an ink droplet is squirted so as to form a print dot by the pressure resulting from the formation of these air bubbles. In this type of recording apparatus, the volume of squirted ink droplets changes as a result of an increase in the temperature of the print head, thereby affecting the print quality. In some cases, air bubbles excessively develop in the print head, thereby clogging a nozzle used for squirting the ink and eventually resulting in print failures. Further, if a printing operation is continued for a long time in a state that the temperature of the print head remains in excess of a critical temperature, air bubbles thermally generated in order to squirt ink droplets may become so large as to be exposed to the outside air as the ink droplets are squirted. In this case, the outside air could enter the nozzle before it is refilled with another ink droplets, resulting in a state that the nozzle has no ink to be squirted. Even in the case of a thermal head, the size of the area of an ink ribbon which is to be thermally fused, or the size of the heat-sensitive area of heat-sensitive paper changes, thereby affecting the quality of the image. If the ink ribbon is heated further, a base material of the ribbon may be fused. In such a thermal print head, constituent parts of the print head are sometimes damaged by heat.

A means disclosed in, e.g., Japanese Examined Patent Publication No. Hei. 5-15387, is known as control means for preventing an increase in the temperature of the print head. In this control means, the gradient of a rise in temperature is calculated from the time elapsed between when a first temperature of the print head is detected and when a second temperature of the sameis detected. A time margin until the upper limit temperature is reached is determined on the basis of the temperature gradient, and the operating temperature standards for a protective circuit used for preventing a temperature rise, are changed on the basis of the thus determined allowance for the time. To prevent a rise in the temperature of the print head, if the temperature gradient is steep, the operating reference temperature is set low. If the temperature gradient is gentle, the operating reference temperature is set high.

In this control means, if the gradient of a temperature rise changes after the operating reference temperature of the temperature-rise preventive circuit has been set by determining the time margin until the upper limit temperature is reached, the accuracy of prevention of a temperature rise will be lowered. More specifically, if the gradient of a temperature rise increases after the operating reference temperature of the protective circuit has been set be determining the time margin until a certain upper limit temperature is reached, the result is an overestimate of the time margin. In this case, the preventive circuit actually operates at a temperature above the upper limit temperature. Conversely, if the gradient of a temperature rise decreases after setting of the operating reference temperature of the protective circuit, the result is an underestimate of the time margin until the upper limit temperature is reached in this case, the protective circuit actually operates at a temperature below the upper limit temperature, resulting in ineffective utilization of the performance of the print head. In short, an error arises in an estimate of the time margin due to a change in the gradient of a temperature rise during operations of the print head, which makes it difficult to attain the intended effect.

Another control means is disclosed in, e.g., U.S. Pat. No. 4,791,435 and Japanese Unexamined Patent Publication No. Sho. 64-38246. In this control means, the print head is cooled by slowly carrying out the printing operation at a certain temperature, or by suspending operation of the print head in one sweep limit position of an encoder scale. If it becomes necessary to cool the print head by suspending its operations the control means is required to move to the sweep limit position of the encoder scale. In many cases, printing operations are usually carried out within an area narrower than the print medium, and hence it is rare for the print head to travel to the sweep limit position of the encoder scale. For this reason, in this control means, it is necessary to move the print head to a normal printable area narrower than the print medium at the time of commencement of the next printing operation, after the print head has been cooled by suspending the operation of the print head in the sweep limit position of the encoder scale. In this way, useless operations of the print head are performed.

Still another control means is disclosed in, e.g., U.S. Pat. No. 4,910,528. The control means is provided with means for counting data to soon be printed. Thermal load which will be imposed on a print head is estimated from the contents of the data. To prevent a rise in the temperature of the print head, either the speed of a printing operation of the print head is reduced, or the printing operation is interrupted. Furthermore, the printing operation is carried out in a divided manner in order to prevent accumulation of heat in the print head. This control means requires the means for the previously counted data to soon be printed. By way of this means, the accuracy of expectation of heat load is improved. However, the means for checking data adds to the cost of the recording apparatus. In addition, it takes too long a time to check data, thereby reducing the print speed.

SUMMARY OF THE INVENTION

The present invention has been conceived in view of the foregoing drawbacks in the prior art. An object of the present invention is therefore to provide a recording control method and a recording apparatus which are capable of following variations in the gradient of a temperature rise, as well as capable of controlling, by means of an inexpensive configuration, the temperature of a print head without causing it to perform useless operations.

According to the invention, there is provided a recording apparatus comprising a print head for thermally forming print dots on a recording medium; head temperature detecting means for detecting a temperature of the print head; environment temperature detecting means for detecting an environment temperature; and print control means for controlling formation of print dots by the print head based on an image to be printed while controlling movement of the print head, and for setting a cooling time based on at least one of a temperature increase time from a time point when the head temperature detecting means detects a first temperature of the print head and a time point when it detects a second temperature of the print head, the number of print dots to be formed during the temperature increase time, and the environment temperature detected by the environment temperature detecting means.

According to another aspect of the invention, there is provided a recording method for controlling formation of print dots on a recording medium by a print head in accordance with an image to be printed while controlling movement of the print head, comprising the steps of measuring a temperature increase time in which a temperature of the print head increases from a first temperature to a second temperature; and determining a cooling time based on at least one of the temperature increase time, the number of print dots to be formed during the temperature increase time, and an environment temperature detected by environment temperature detecting means.

DESCRIPTION OF THE PREFERRED EMBODIMENT

Figure 1:
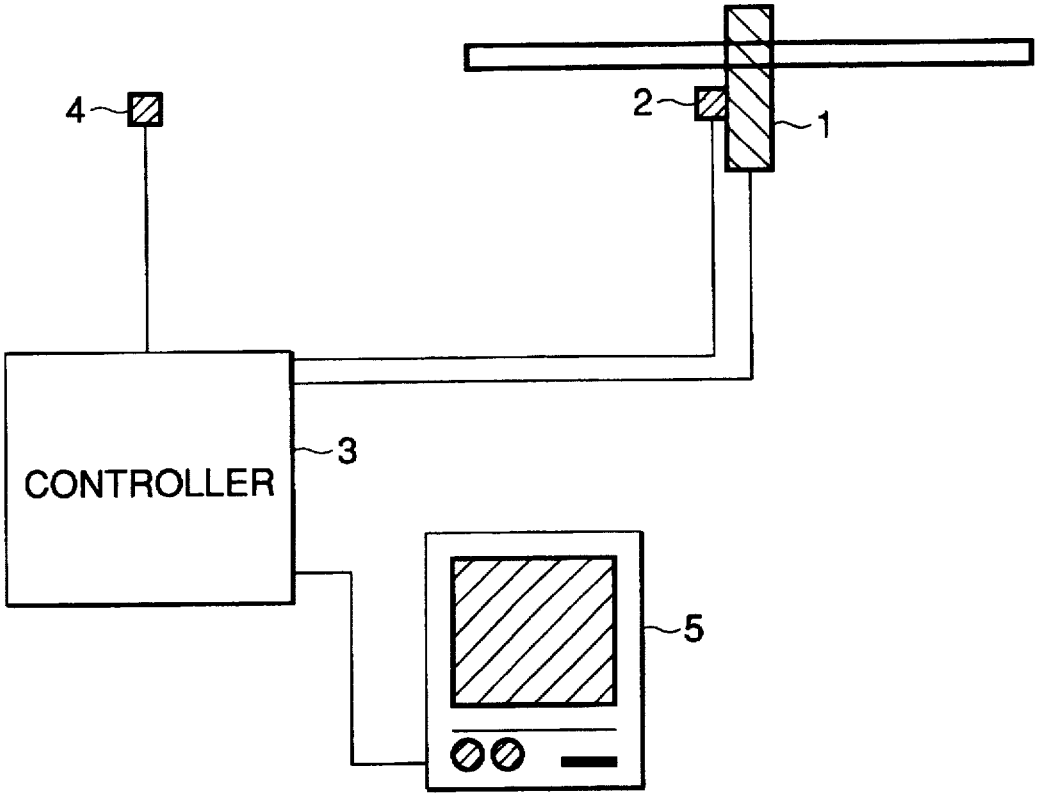
FIG. 1 is a block diagram illustrating a recording apparatus according to an embodiment of the present invention.

FIG. 1 is a block diagram of a recording apparatus according to an embodiment of the present invention. In the drawing, reference numeral 1 denotes a print head; 2, a head temperature detection thermistor; 3, a controller; 4, an environment temperature detection thermistor; and 5, a personal computer.

The print head 1 is a so-called serial head having a narrow print width. One array (or a plurality of arrays) of nozzles are arranged on the print head 1 for squirting ink (not shown). For example, 128 nozzles may be arranged in one array on the print head 1, at a density of 300 dpi. The print head 1 performs a printing operation for one band corresponding to the print width by squirting ink from the nozzles while being moved in the direction substantially at right angles to the direction of arrangement of the nozzles. One page is printed by printing operations for a plurality of bands. The head temperature detection thermistor 2 is mounted on the print head 1 and detects its temperature. The thus-detected temperature is sent to the controller 3. The environment temperature detection thermistor 4 detects environment temperature and sends the thus-detected environment temperature to the controller 3. The controller 3 monitors the temperature of the print head 1 at all times by use of a signal received from the head temperature detection thermistor 2. Further, the controller 3 is capable of determining environment temperature at all times by use of a signal received from the environment temperature detection thermistor 4. The controller 3 controls driving of the print head 1 in accordance with data received from the personal computer 5 in response to a print command, to squirt ink toward a recording medium. Further, the controller 3 controls feed timing of the recording medium. Thus, an image is recorded.

Figure 2:
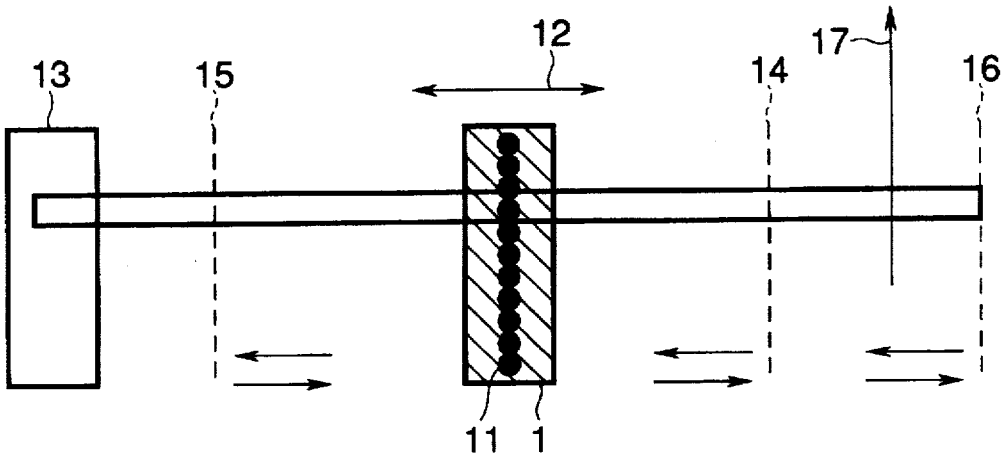
FIG. 2 is a schematic representation illustrating one example of operation of a print head used in the recording apparatus of the embodiment of the present invention.

FIG. 2 illustrates one example of operation of the print head used in the recording apparatus according to the embodiment of the present invention. In the drawing, reference numeral 11 denotes a nozzle; 12, the direction of serial operation; 13, a home position; 14, a print end point; 15 and 16, sweep limits; and 17, movement of the recording medium. The print head 1 comprises an array of nozzles 11. The print head 1 performs a printing operation for one band while traveling in the direction of serial operation 12. The home position 13 is a standby position for the print head 1 when the faulty nozzles 11 are subjected to maintenance or when the print head 1 remains inactive and stationary for a long period of time. If remaining inactive and stationary for a long period of time, the print head 1 is covered with a cap in order to prevent ink from drying up. The sweep limits 15 and 16 are lateral limits of the range over which the print head 1 is capable of traveling during printing operations. In other words, the sweep limits define an region that is a printable region plus the distances required by the print head 1 to carry out acceleration and deceleration. The print end position 14 is an example of the position where the print data terminates.

The squirting of ink of each nozzle 11 is controlled according to the serial operation of the print head 1, whereby an image is formed for a nozzle width (i.e., a band width). Normally, the print head 1 moves to the next operation immediately after print data corresponding to one band has terminated. For example, if a printing operation is limited to a one-way operation, the print head 1 will return to the sweep limit 15 immediately after having passed the print end position 14. Zn the cane of a bidirectional printing operation, the print head 1 moves to the closer one of the left and right end of an area where print data for the next band exists. Subsequently, the recording medium, such as paper, is fed by a one-band distance in the direction 16 that is perpendicular to the direction in which the print head 1 performs serial operations. Then, an image of another band is formed. The entire image is formed through these operations.

The operation of the recording apparatus according to the embodiment of the present invention will now be described by way of a specific example.

In this example, a printing operation is to be carried out while the temperature of the print head 1 is prevented from exceeding 55° C. If a printing operation Is continued for a long period of time while the temperature of the print head 1 is in excess of its upper limit, air bubbles will excessively arise In the ink stored in the print head. If the temperature of the print head 1 exceeds further, air bubbles generated by heat to squirt ink may become so large as to be exposed to the outside air as the ink is squirted. In this case, the outside air could enter the nozzles before they are refilled with ink, resulting in a state that the nozzles have no ink to be squirted. It has also been experimentally confirmed that the constituent components of the print head 1 are damaged by heat. To prevent these problems, the upper limit of the temperature of the print head 1 is set. In the present example, the upper limit is set to 55° C.

Figure 3:
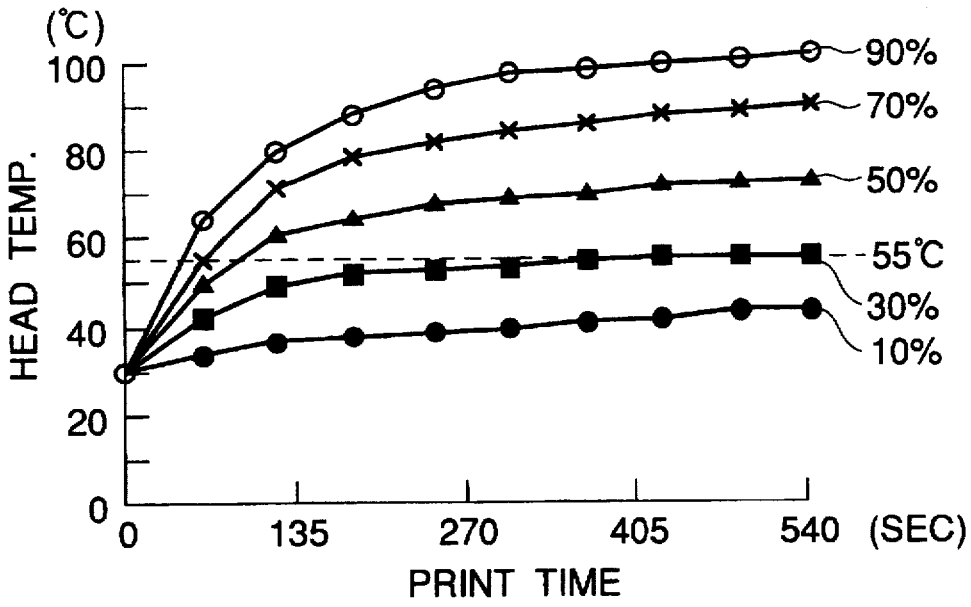
FIG. 3 is a plot illustrating an example of the relationship between a print density and the temperature of the print head.

FIG. 3 is a plot showing one example of the relationship between the print density and the temperature of the print head. The plot provided in FIG. 3 shows variations in the temperature of the print head 1 for several print densities in a case where a printing operation is carried out continuously at a such rate that printing on an A4-size sheet is completed in 13 seconds under conditions that the environment temperature is 28° C. and the nozzle drive frequency is 7 kHz. The print density is defined by a ratio of the number of dots for which ink is squirted to the total number of nozzles (the evaluation is performed over a unit time). In the drawing, a curve of a print density 90% is represented by ○. Similarly, curves of print densities 70%, 50%, 30%, and 10% are respectively represented by ×, Δ, ■, and ●. As can be seen from the curves, continuous printing operations may cause the temperature of the print head 1 to exceed the upper limit temperature 55° C. at some print density values. It is also seen that the time required for the temperature to exceed the upper limit temperature varies with the print density.

Figure 4:
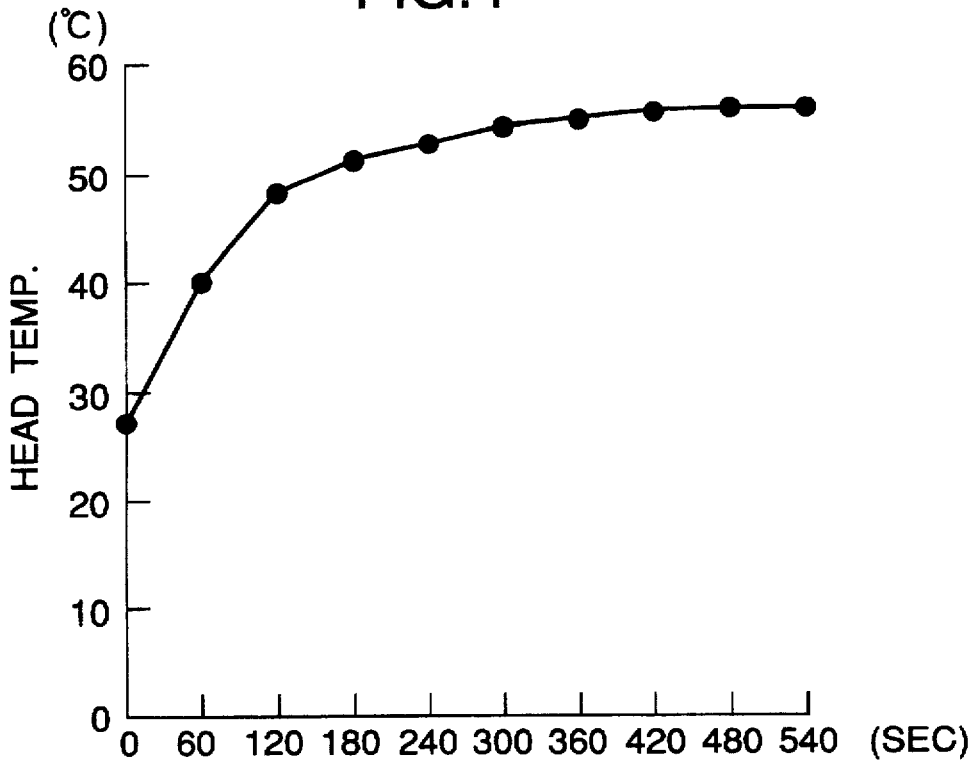
FIG. 4 is a plot illustrating an example of an increase in the temperature of the print head at a print density of 50% with changes in printing speed.

FIG. 4 shows a graph illustrating one example of an increase in the temperature of the print head at a print density of 50% when the printing speed is changed from the above case. In the example shown in FIG. 3, the printing operation is continuously carried out at such a rate that printing on an A4-size sheet is completed in 13 seconds. In contrast, FIG. 4 shows a graph obtained in a case where printing operations were continuously carried out at a different printing speed, i.e., at such a rate that printing on an A4-size sheet is completed in 22 seconds. In this example, the printing density is set at 50%. Of the curves shown in FIG. 3, the one with the print density of 50% shows that the temperature of the print head exceeds 60° C. as a result of continuous printing operations. However, when the printing speed was reduced, the temperature of the print head does not exceed 55° C. even if continuous printing operations are carried out, as shown in FIG. 4. As described above, even at the print density of 50%, it is possible to perform continuous printing operations without causing the temperature of the print head 1 to exceed the upper limit temperature of 55° C. if the printing is carried out at as slow a rate as 22 seconds for an A4-size sheet.

For example, where 128 nozzles 11 are arranged in the print head 1 at a density of 300 dpi, the print width of one band is calculated as 300 dpi ×128=10.8 mm. Where printing is performed on an A4-size sheet while serial operations are conducted in the shorter-axis direction of the sheet, the print head 1 is moved about 28 times as calculated such that 297 (length of A4-size sheet)/10.8 (width of one band). To effect printing at a rate of 24 seconds per A4-size sheet in the recording apparatus capable of printing at a rate of 13 seconds per A4-size sheet as in the example of FIG. 3, it is only required to set a waiting time of (24–13)/28=0.39 second for the printing of each band. in other words, by controlling the waiting time after one-band printing without changing the one-band printing speed, continuous printing operations can be performed such that the temperature of the print head 1 does not exceed the upper limit temperature of 55° C.

Figure 5:
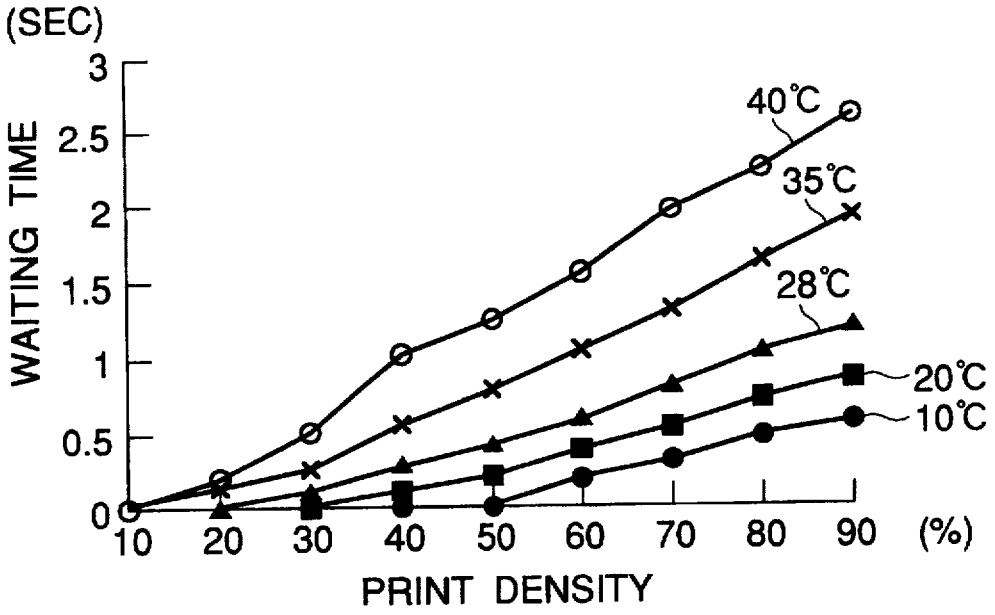
FIG. 5 is a plot illustrating an example of print waiting time to keep the temperature of the print head appropriate as a function of the print density with several environment temperatures.

FIG. 5 shows a graph illustrating one example of the waiting time required to keep the temperature of the print head 1 appropriate as a function of the print density with several environment temperatures. As previously described, it is possible to control the temperature of the print head 1 so that it does not exceed the upper limit temperature of 55° C. by controlling the waiting time for each band. FIG. 5 shows a waiting time to be set for each band in order to enable continuous printing operations for each print density at each environment temperature without causing the temperature of the print head 1 to exceed 55° C. As the environment temperature becomes higher, a longer waiting time is required because the heat dissipation of the print head 1 is more hindered. When the environment temperature is low, in which case the heat of the print head 1 is easily dissipated, the waiting time can be reduced. By use of the graph shown in FIG. 5, it is possible to determine a waiting time for each band based on an environment temperature and a print density.

Figure 6:
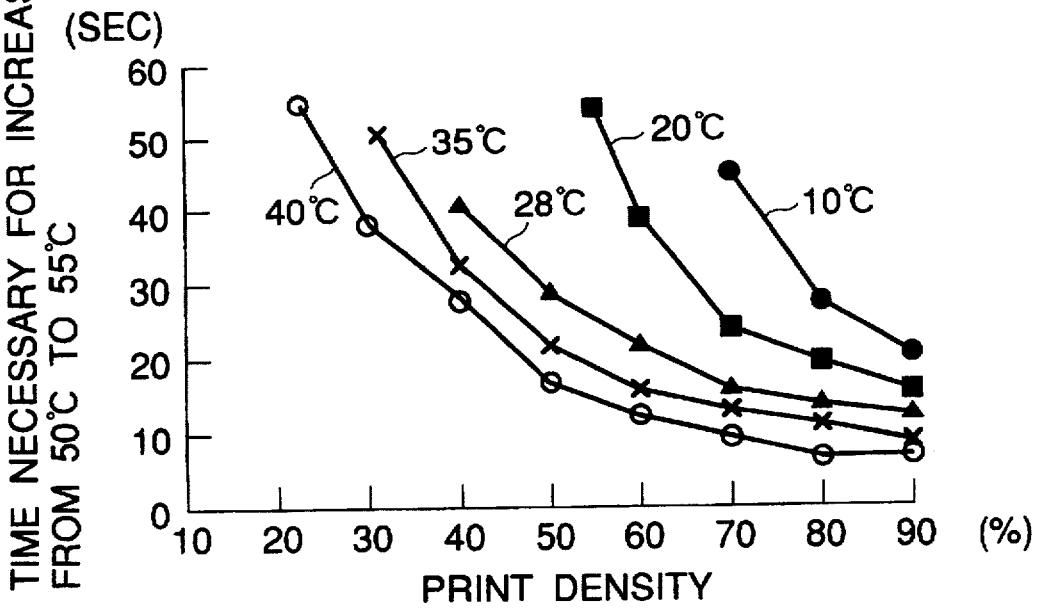
FIG. 6 is a plot illustrating an example of the time in which the print head temperature increases from a first temperature to a second temperature as a function of the print density with several environment temperatures in a case where a continuous printing operation is performed.

FIG. 6 illustrates a graph showing one example of the time in which the temperature of the print head 1 increases from a first temperature to a second temperature when continuous printing operations are carried out, as a function of the print density with several environment temperatures. As can be seen from the graph of FIG. 3, the tendency of temperature increase of the print head 1 varies with the print density. Moreover, this tendency depends on the environment temperature. The graph of FIG. 6 illustrates the time in which the temperature of the print head 1 increases from 50° C. to 55° C. for each print density at each environment temperature. In the drawing, curves of environment temperatures 10° C., 20° C., 28° C., 35° C. and 40° C are respectively represented by ●, ■, Δ, ×, and ○. As shown in FIG. 6, as each of the environment temperature and the print density increases, the temperature of the print head 1 increases from 50° C. to 55° C. in a shorter period. Conversely, as each of the environment temperature and the print density decreases, the temperature of the print head I increases from 50° C. to 55° C. in a longer period.

By using the curves of FIG. 6 in a reversed manner, it is possible to calculate a print density from an environment temperature and a time in which the temperature of the print head 1 increases from 50° C. to 55° C. For example, the data of the curves of FIG. 6 are stored in a memory of the controller 3. Given time t1 when the head temperature Th reaches 50° C. and time t2 when it reaches 55° C. as a result of continuous increase, a period t3 in which the head temperature Th increases from 50° C. to 55° C. is calculated as $$t3=t2-t1.$$

On the other hand, an environment temperature Tenv1 is determined from a value detected by the thermistor 4. A print density P1 can be calculated from the time t3, the environment temperature Tenv1, and the data of the curves of FIG. 6 which is stored in the memory of the controller 3.

FIG. 5 illustrates the waiting time W to be set for each band to enable continuous printing operations at each environment temperature Tenv for each print density P without causing the temperature of the print head 1 to exceed 55° C. A waiting time W1 to be set for each band to enable continuous printing operations without causing the temperature of the print head 1 to exceed 55° C. can be calculated according to the curves of FIG. 5 by using the environment temperature Tenv1 and the print density P1 obtained from the data of the curves of FIG. 6. Data of the curves of FIG. 5 can also be stored in the memory of the controller 3.

As described above, it is possible to calculate the waiting time W1 to be set for each band according to the data of the curves of FIGS. 5 and 6 by using the time t3 in which the temperature of the print head 1 increases from 50° C. to 55° C. and the environment temperature Tenv1. The subsequent print control may be so performed that the thus-calculated waiting time W1 is provided every time a printing operation for one band is completed.

Instead of storing the data of the curves of FIGS. 5 and 6 in the memory of the controller 3, the data can be provided in the controller 3 in the form of formulae derived from those data. Although in the above description the waiting time W1 is determined from the time in which the temperature of the print head 1 increases from 50° C. to 55° C. as an example, these temperatures can be arbitrarily set so long as they do not exceed the upper limit temperature. That is, as in the case of the data of FIG. 6, data to be used for calculating the print density from the environment temperature and the time in which the temperature of the print head 1 increases from a preset first temperature to a preset second temperature are obtained in advance. The print density is obtained from the above data, whereby the waiting time W1 is set. It is also possible to directly determine the waiting time W1 from the temperature increase time and the environment temperature by combining data used for calculating the print density from the temperature increase time and the environment temperature and data used for determining the waiting time from the print density and the environment temperature, i.e., data as shown in FIGS. 5 and 6.

Figure 7:
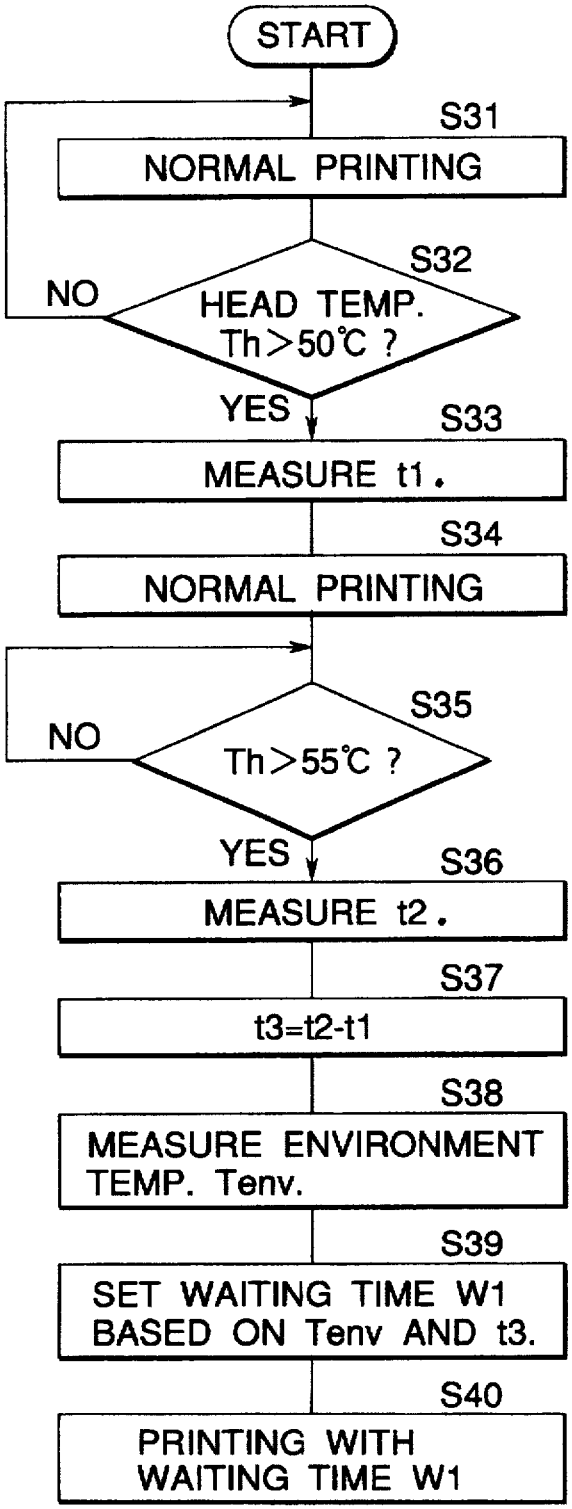
FIG. 7 is a flowchart illustrating an example of operation of the recording apparatus of the embodiment of the present invention.

FIG. 7 is a flowchart showing one example of operation of the recording apparatus according to the embodiment of the present invention. To summarize the above, the controller 3 needs to execute the procedure of FIG. 7. First, a normal printing operation is carried out in step S31 at the beginning of a printing job. During the printing operations, it is constantly monitored in step S32 whether the temperature Th of the print head 1 has exceeded 50° C. If the temperature Th of the print head I has exceeded 50° C., time ti at which the temperatures Th has exceeded 50° C. is measured and stored in step S33. While the normal printing operation is continued in step S34, it is monitored in step S35 whether the temperature Th of the print head 1 has exceeded 55° C. If the temperature Th of the print head 1 has exceeded 55° C., time T2 when the temperature Th of the print head 1 has exceeded 55° C. is measured in step S36. A period t3 in which the temperature of the print head 1 increased from 50° C. to 55° C. is calculated in step S37 according to t3=t2−t1. Moreover, an environment temperature Tenv is measured by the environment temperature detection thermistor 4 in step 538. In step S39, a waiting time W1 is determined based on the time t3 and the environment temperature Tenv by using the data of the curves of the FIGS. 5 and 6 in turn. Subsequently, in step S40, control is performed such that the thus-set waiting time W1 is effected every time a printing operation on one band is completed, and then a printing operation on the next band is started. In this way, continuous printing operations can be carried out while the temperature of the print head 1 is kept within the upper limit temperature of 55° C.

As described above, by measuring the period taken by a temperature change and performing print control based on the measured period and the environment temperature, it becomes unnecessary to previously count data to be soon printed as is carried out in the prior art. To previously count print data before it is printed, where only an ordinary data buffer is used, it takes much time to count the print data after it has been stored in a buffer. It is also conceivable to previously store print data in another buffer and to count it in advance. However, in this case, a buffer which is twice as large as an ordinary buffer is necessary, resulting in a cost increase. In contrast, the method of the present invention in which the temperature variation time is measured allows real-time processing and eliminates the need for a large buffer. Therefore, this method can be implemented at a low cost.

Figure 8:
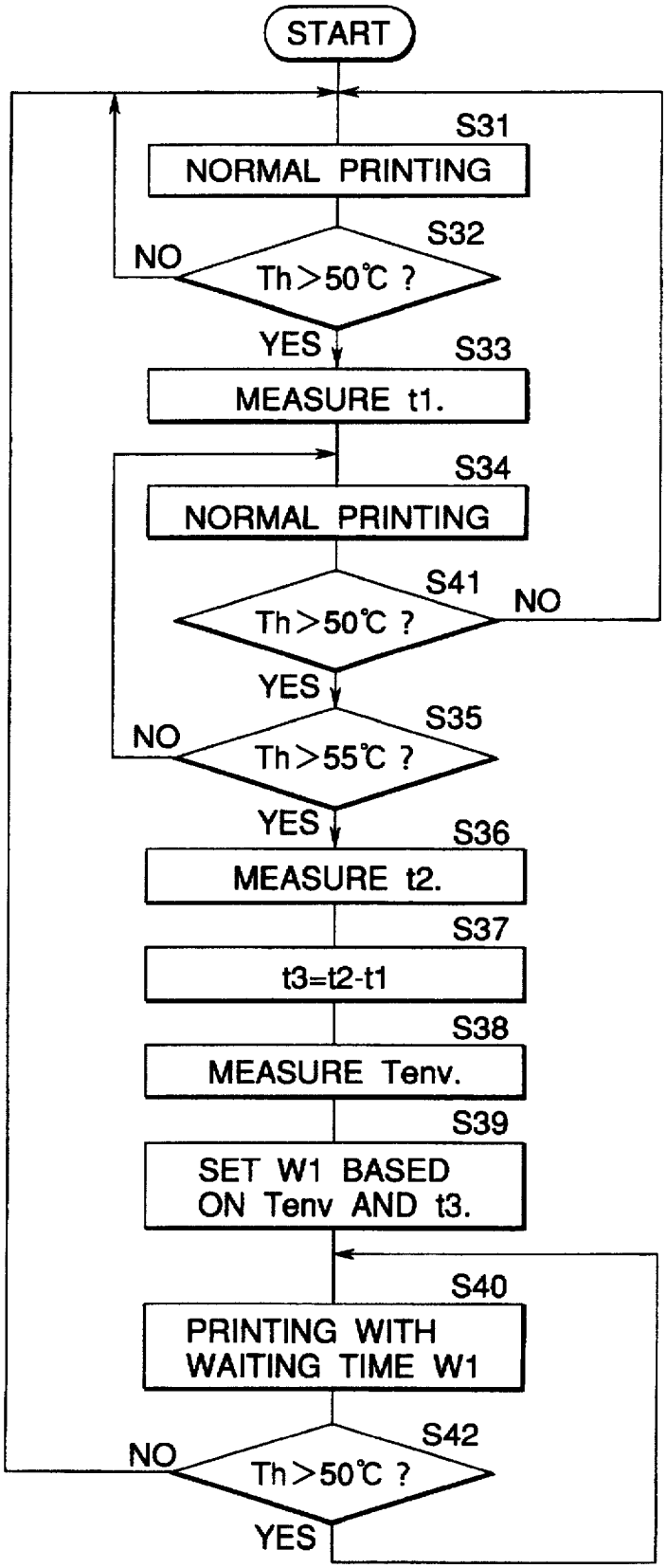
FIG. 8 is a flowchart illustrating an operation in which steps to be performed when the temperature of a print head decreases sufficiently by setting a waiting time are added to the operation of FIG. 7.

FIG. 8 is a flowchart illustrating another example of operation of the recording apparatus according to the embodiment of the present invention which includes steps for a case where the head temperature decreases sufficiently by setting the waiting time. In FIG. 8, the same steps as those shown in FIG. 7 are assigned the same reference numerals. As the print control proceeds while the waiting time W1 is set through the processing as shown in FIG. 7, there may occur a case that the temperature of the print head 1 sufficiently decreases due to, for instance, a change in print density P1 or environment temperature Tenv1, or the cooling effect of setting the waiting time W1. In such a case, it may become unnecessary to set a waiting time, or an already set waiting time becomes unnecessary. In FIG. 8, steps for such a case are added.

Assume that the temperature Th of the print head 1 exceeds 50° C. in step S32, and that time t1 of this event is measured in step S33. In this case, it is monitored in step S35 whether the temperature Th of the print head 1 further increases to exceed 55° C. while the normal printing operation is performed in step S34. In some cases, the temperature Th of the print head 1 becomes lower than 50° C. after having exceeded it. In this case, time t1 is remeasured when the temperature Th of the print head 1 exceeds 50° C. again. To this endit is monitored in step S41 whether the temperature Th of the print head 1 is in excess of 50° C. If the temperature Th of the print head 1 becomes lower than 50° C., the process returns to step S31 to perform the ordinary printing operation. In this event, since the temperature Th of the print-head 1 does not increase and remains below 55° C., as a matter of course the setting of a waiting time for the cooling purpose is not carried out and the temperature control using the waiting time is not started. If the temperature Th of the print head 1 exceeds 50° C. again, time t1 when the temperature Th exceeds 50° C. is rewritten. Therefore, correct temperature control can be realized.

If the temperature Th of the print head 1 exceeds 55° C. past 50° C., the waiting time is set in steps S36 to S39 and temperature control for cooling the print head 1 is started in step S40. There may occur a case that the temperature Th of the print head 1 thereafter becomes lower than 50° C. again due to the cooling effect of setting the waiting time, which means that the temperature Th of the print head 1 has returned to the initial state below 50° C. In view of this, it is monitored in step 542 whether the temperature Th of the print head 1 is below 50° C. If the temperature Th of the print head 1 has become lower than 50° C., the cooling by setting the waiting time is stopped. The process returns to step S31 to perform the ordinary printing operation. With the above control, even if the head temperature decreases sufficiently by virtue of a decrease in print density P1 or environment temperature Tenv1 after setting of the waiting time, or of the temperature control by setting of the waiting time for the cooling purpose, it is possible to carry out printing operations without unduly continuing the setting of the waiting time, thus realizing printing that is free of useless operations.

The temperature of the print head 1 used as a judgment criterion in step S42 is not limited to 50° C. For example, the temperature may be so set that the ordinary printing operation is started after the print head 1 is cooled to about 45° C. Although the criterion temperature may be set higher than 50° C., it is desirable to set the criterion temperature in step S42 below that in step S32, allowing for a case where the temperature Th of the print head 1 increases again after the ordinary printing operation is resumed.

Figure 9:
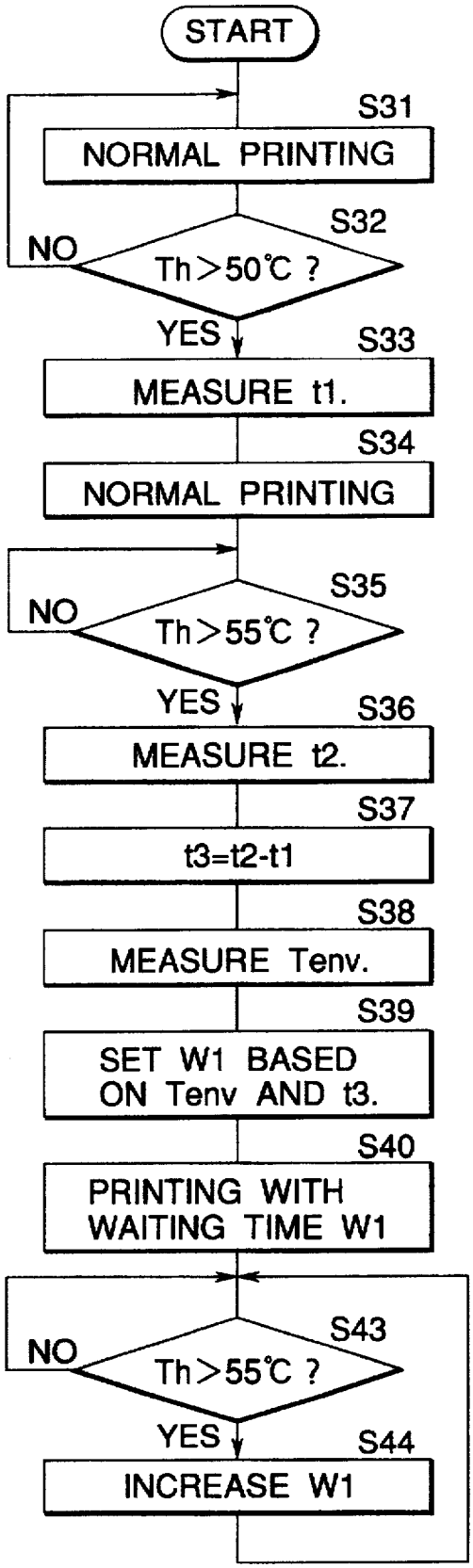
FIG. 9 is a flowchart illustrating an operation in which steps to be performed when the temperature of the print head does not decrease in spite of setting of the waiting time are added to the operation of FIG. 7.

FIG. 9 is a flowchart showing one example of operation of the recording apparatus according to the embodiment of the present invention including steps for a case where the head temperature does not decrease in spite of the setting of the waiting time. In FIG. 9, the same steps as those shown in FIG. 7 are assigned the same reference numerals. As the print control proceeds while the waiting time W1 is set by the steps of FIG. 7, there may occur a case that the cooling effect of the thus-set waiting time W1 cannot decrease the temperature of the print head 1 does because of, for instance, an increase in print density P1 or environment temperature Tenv1. In such a case, it is necessary to increase the waiting time W1 because the currently set waiting time W1 is insufficient. In FIG. 8, steps for such a case are added.

The waiting time W1 is set through the processing carried out to step S39 by using the environment temperature Tenv1 and time t3 in which the temperature of the print head 1 increases from 50° C. to 55° C. Print control for cooling the print head 1 is performed in step S40 by using the thus-set waiting time W1. During the course of the print control, it is, determined in step S43 whether the temperature Th of the print head 1 has exceeded 55° C., that is, whether the currently set waiting time W1 is sufficient to cool the print head 1. If the temperature Th of the print head 1 exceeds 55° C., the waiting time W1 is increased and reset in step S44. The print control for cooling the print head 1 is performed again in step S40 by using the newly set waiting time. The increase of the waiting time W1 can ba previously sets a constant time may be added to the current time, or the current time may be multiplied by a constant factor, Alternatively, the increase of the waiting time W1 can be determined in consideration of, for instance, the temperature Th of the print head 1 or the degree of increase in temperature.

If the print density P1 or the environment temperature Tenv1 increases to cause a state that the waiting time W1 that has been set for each band becomes too short to decrease the temperature Th of the print head 1 to below 55° C., the controller 3 sets a new waiting time W2 in step S44 by simply doubling the waiting time W1. The print control is performed in the steps ensuing step S40 by using the thus-set waiting time W2. There may even occur a case that the temperature Th of the print head 1 still exceeds 55° C. in spite of such a print control operation. In such a case, a new waiting time W4 is set by, for instance, simply doubling the waiting time W2 in the manner as previously carried out. The print control is performed using the thus-set waiting time W4. By repeating the above-described operations several times, the waiting time can necessarily be set at a time that is sufficient to prevent an increase in the temperature Th of the print head 1.

Although during the resetting of the waiting time the printing is continued with the temperature Th of the print head 1 in excess of the upper limit temperature, an increase in the temperature Th of the print head 1 which is caused during printing of only one band is not so large actually even if the print density is high. Even if the above-described operations are carried out several times, it is possible to suppress the increase in the temperature Th of the print head 1 to a small value. Consequently, it is possible to substantially prevent an increase in the temperature of the print head.

Figure 10:
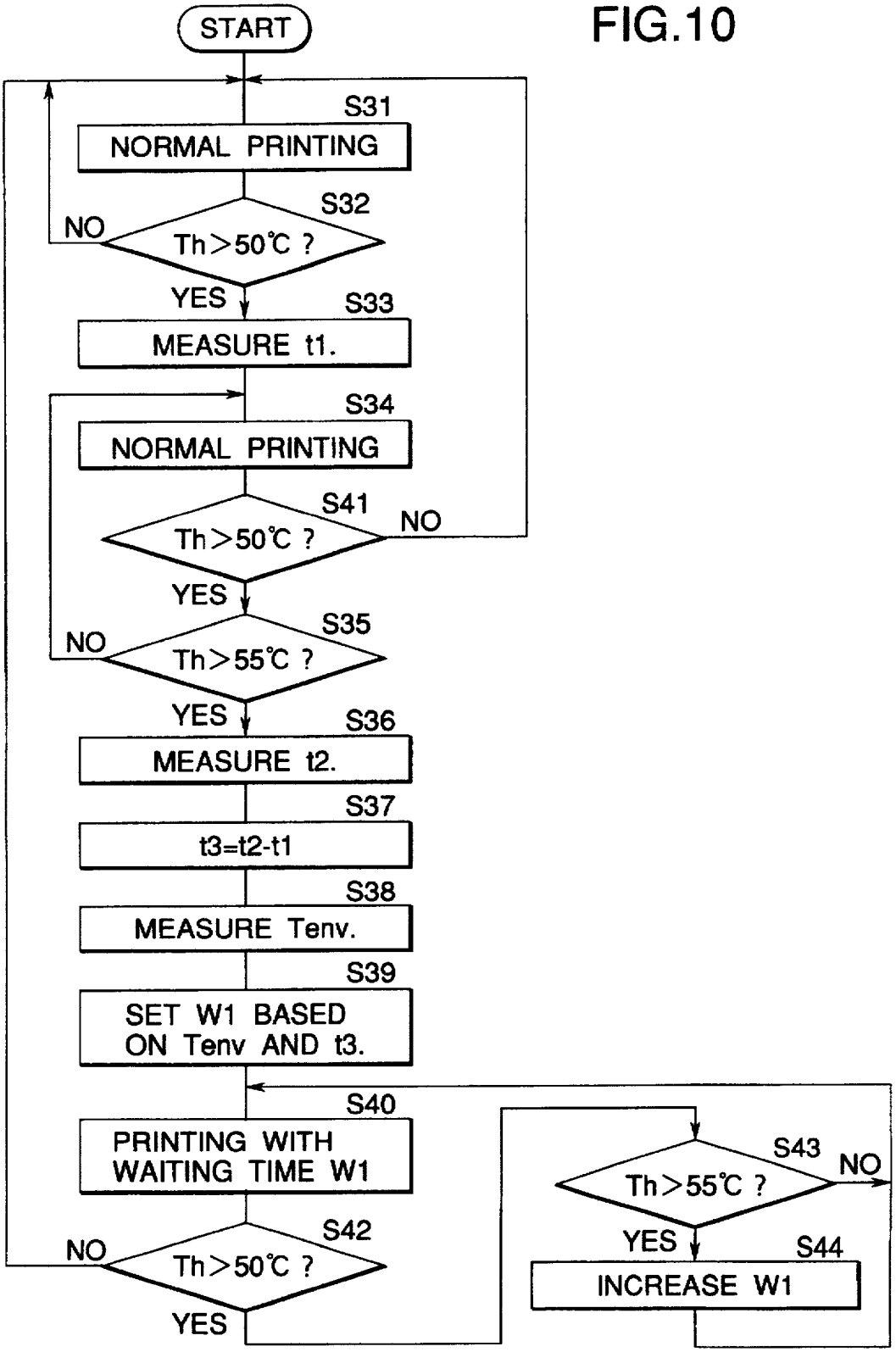
FIG. 10 is a flowchart illustrating an operation in which both of the steps to performed when the temperature of the print head decreases sufficiently by setting the waiting time and the steps to be performed when the temperature of the print head does not decrease in spite of setting of the waiting time are added to the operation of FIG. 7.

FIG. 10 is a flowchart illustrating one example of operation of the recording apparatus according to the embodiment of the present invention which includes steps for both of a case where the temperature of the print head decreases by setting the waiting time and a case where the temperature of the print head does not decrease in spite of setting of the waiting time. In FIG. 10, the same steps as those provided in FIGS. 7 through 9 are assigned the same reference numerals. The flowchart of FIG. 10. is one obtained by adding, to the flowchart of FIG. 7, the steps for the case where the temperature Th of the print head 1 decreases sufficiently by setting the waiting time (see FIG. 8), and the steps for the case where the temperature Th of the print head 1 does not decrease in spite of the setting of the waiting time (see FIG. 9). According to the process of FIG. 10, the waiting time for cooling is set, is canceled when it is unnecessary, or is increased when the cooling effect is insufficient, in accordance with the temperature Th of the print head 1, the environment temperature, and the print density. Consequently, it is possible to keep the temperature of the print head 1 optimum and to carry out efficient printing operations at all times .

Where control operations, such as cancellation or increase of a previously set waiting time, are carried out as shown in the flowcharts in FIGS. 7–10, particularly in FIGS. 8–10, it is possible to set a tentative waiting time and then cancel or increase it. The tentative waiting time may be calculated from only the environment temperature with the temperature increase time fixed or, conversely, from only the temperature increase time with the environment temperature fixed.

Figure 11A:
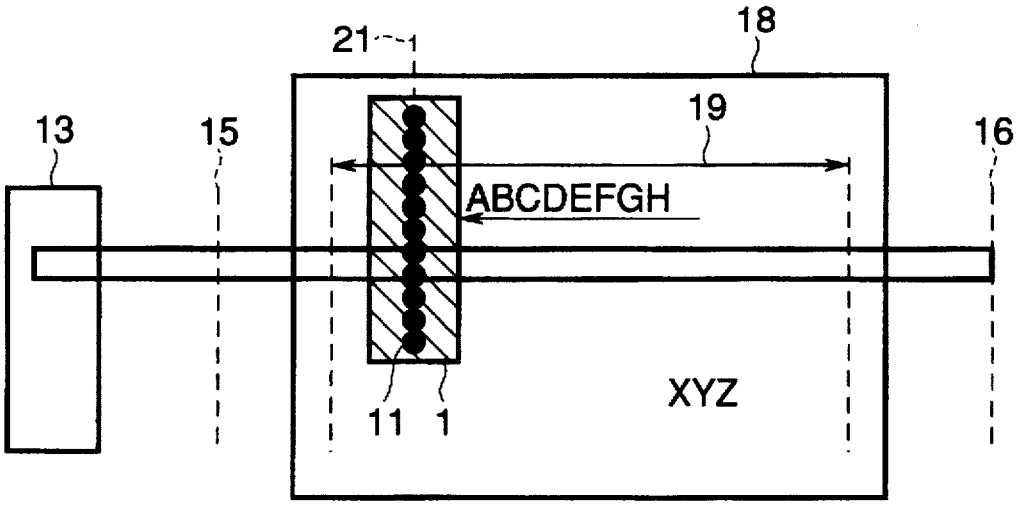
FIGS. 11A and 11B are comparative illustrations for explaining the operation of a print head used in the recording apparatus of the embodiment of the present invention and that in a conventional recording apparatus.
Figure 11B:
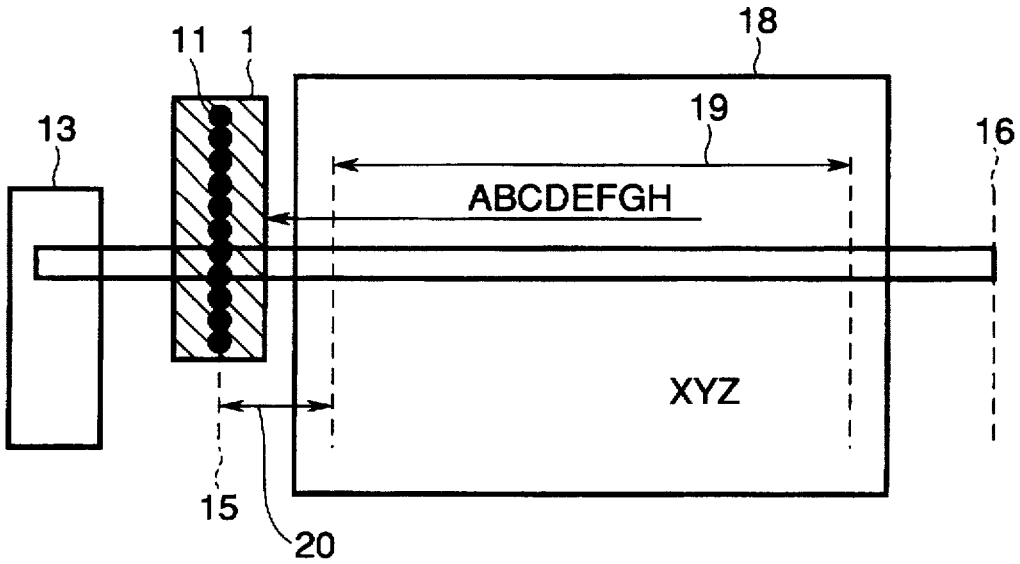
FIG.11B PRIOR ART

Figs. 11A and 11B are comparative illustrations for explaining operations of print heads used in the recording apparatus of the embodiment of the present invention and in a conventional recording apparatus. In FIGS. 11A and 11B, the same elements as those in FIG. 2 are assigned the same reference numerals. Reference numeral 18 denotes a recording medium; 19, a printing area; 20, a distance between the sweep limit 15 and the printing area 19; and 21, a stop position of the print head 1. The position where the print head 1 stands by for the waiting time that is set in the above-described manner may be a position where the print head is located immediately after a one-band printing operation or immediately before the next one-band printing operation.

According to the control of operation of a print head as disclosed in, e.g., U.S. Pat. No. 4,791,435 and Japanese Unexamined Patent Publication No. Sho. 64-38246, as shown In Fig. 11B, the operation of the print head 1 is stopped and cooled at the sweep limit 15 or 16 of the encoder scale. Therefore, when it becomes necessary to stop the operation of the print head 1 for the cooling purpose, the print head 1 needs to move to the sweep limit 15 or 16 of the encoder scale. Usually, printing operations are carried out within the printing area 19 that is narrower than the width of the recording medium 18; it is rare that the print head 1 is moved to the sweep limit 15 or 16 of the encoder scale. For this reason, according to the conventional operation control, it is necessary that the print head 1 be stopped after being moved to either the sweep limit 15 or 16 of the encoder scale, and that after being cooled the print head 1 be again moved to the printing area 19 that is narrower than the recording medium 18 and is usually used for printing operations at the time of commencement of the next printing operation. Thus, the print head 1 has to travel the distance 20 between the sweep limit and the printing area 19 uselessly.

In the embodiment of the present invention, as shown in Fig. 11A, the movement of the print head 1 is stopped for the cooling purpose immediately after print data for a certain band has terminated, regardless of the sweep limit 15 or 16 of the encoder scale. In this case, the stop position 21 of the print head 1 is within the narrow printing area 19 that is usually used. Therefore, it is possible to eliminate the useless return of the print head 1 from the sweep limit to the printing area 19 which is conventionally required when the next printing operation is commenced.

Although the above description is directed to the case where the operation of the print head 1 is suspended for the waiting time being set after the printing operation for one band has been completed, the present invention is not limited to this case. For example, the recording apparatus may be constructed such that the waiting time is inserted in a collective manner after printing operations for a plurality of bands have been completed. Where print control is performed such that waiting time is inserted for a plurality of bands, if the temperature of the print head 1 does not become lower than the upper limit temperature, the interval of inserting the waiting time may be reduced instead of increasing the waiting time in step S44 in FIGS. 9 and 10. For example,. if the temperature of the print head 1 does not decrease even if waiting time is inserted for every two bands, the print control may be changed such that the waiting time is inserted for every band.

The print head 1 is not limited to a serial head but may be, e.g., a line head having a wider print width. In this case, if excessive heat has developed in the print head, a printing operation may be suspended for a waiting time being set immediately after the line head has finished printing of one or a plurality of lines, regardless of continuation of its movement and, after being cooled sufficiently, the print head may resume the printing operation. With this arrangement, the temperature of the line head can be controlled as in the case of the serial head. Further, the present invention is not limited to control of the above-described ink-jet type print head, but can be applied to control of other various types of heat-generating print heads such as a thermal print head.

As is evident from the previous descriptions, according to the present invention, cooling time for certain print intervals in order to prevent heat from being excessively accumulated in a print head, is determined using at least either the time elapsed between when a first temperature of the print head is detected and when a second temperature of the same is detected, or environment temperature at that time. The thus-determined cooling time is set for each specific print Interval after the second temperature has been detected. In this case, it is possible to control the temperature of the print head immediately before the start of the temperature suppressing control, and therefore the printing operation can be controlled with high accuracy. In this event, the time required in the prior art to analyze print data becomes unnecessary. In addition, a buffer for analyzing print data becomes also unnecessary. It is possible to inexpensively control the print head for cooling purposes in real time. Further, a control operation to prevent a rise in the temperature of the print head can be carried out so as to follow variations in print density, environment temperature, etc. during the course of printing operations. The printing operations are continued without reducing the printing speed, regardless of the degree of the gradient of a rise in temperature, until the temperature of the print head reaches the second temperature. In consequence, the print head can perform printing operations with full utilization of its ability.

As previously described, conventionally, if a printing operation is continued for a long period of time while the temperature of the print head is in excess of the upper limit temperature, air bubbles excessively develop in the ink stored in the print head. Further, if the temperature of the print head increases further, air bubbles which are generated by heat to squirt ink become so large as to be exposed to the outside air as the ink is squirted. The thus-increased outside air enters the nozzles before they are refilled with ink, so that the nozzles become empty of ink to be squirted next time. Further, the constituent parts of the print head are damaged by heat. These problems can be prevented by virtue of the above-described control operation for the cooling purpose.

The print control is performed using a cooling time that is set after the second temperature has been detected. If the temperature of the print head becomes lower than a predetermined temperature, the setting of the cooling time is canceled and the printing operation is performed by utilizing the same printing method as used prior to the detection of the second temperature. Since there does not occur a case that the unnecessary cooling time is set continuously even after the temperature of the print head has decreased, the print throughput is not reduced.

If the temperature of the print head exceeds the upper limit temperature even when the print control is carried out by using the cooling time being set, the degree of temperature increase suppression is quickly increased. In this way, the temperature increase suppression Is effected on a real-time basis. As a result, even if, for instance, the gradient of temperature increase is changed immediately after detection of the second temperature, the temperature increase suppression effect is ensured. That is, if the gradient of an increase in the temperature increases immediately after the detection of the second upper limit temperature, and if the temperature of the print head exceeds the upper limit temperature even after previously set cooling time has been set for every print interval, the cooling time for every print interval is elongated, thereby increasing the temperature increase suppression effect. As a result, the risk of the temperature of the print head exceeding the upper limit temperature is minimized, and the temperature increase suppression is achieved.

As described above, it is possible to always ensure an optimum temperature for the print head and to realize efficient printing operations by setting the cooling time, canceling the cooling time if it becomes unnecessary, or increasing the cooling time if it becomes insufficient to cool the print head, in accordance with the temperature of the print head, the environment temperature, and the print density.

When it becomes necessary to suspend the operation of the print head or to cool it, the movement of the print head is immediately stopped for the purpose of cooling after a printing operation for a certain interval. As a result, various advantageous results are obtained; for example, it becomes unnecessary for the print head to travel to the sweep limit of the encoder scale, whereby useless movement of the print head is eliminated.

What is claimed is:

1. A recording apparatus for forming print dots on a recording medium, each page of the recording medium including a plurality of bands, the recording apparatus comprising:

a print head for thermally forming print dots on a recording medium;

head temperature detecting means for detecting a temperature of the print head;

environment temperature detecting means for detecting an environment temperature; and print control means for controlling formation of print dots by the print head based on an image to be printed while controlling movement of the print head, and for setting a cooling time for each band of the plurality of bands based on at least two of a temperature increase time from a time point when the head temperature detecting means detects a first temperature of the print head and a time point when it detects a second temperature of the print head, the number of print dots to be formed during the temperature increase time, and the environment temperature detected by the environment temperature detecting means.

2. The recording apparatus as defined in claim 1, wherein the print control means sets the cooling time for each of print bands after detection of the second temperature, suspends print dot formation by the print head and movement of the print head during the cooling time, and resumes the print dot formation by the print head and the movement of the print head after a lapse of the cooling time.

3. The recording apparatus as defined in claim 2, wherein in suspending the movement of the print head, the print control means stops the print head immediately after completion of printing of each of the print bands irrespective of a position of the print head.

4. The recording apparatus as defined in claim 2, wherein the print control means cancels the cooling time to thereafter cause printing according to a printing method that was used prior to detection of the first temperature, when the temperature of the print head becomes lower than the first temperature during or after completion of printing of a print band after detection of the second temperature.

5. The recording apparatus defined in claim 2, wherein the print control means increases the cooling time, when the temperature of the print head exceeds the second temperature or a predetermined third temperature at a time point when printing has been performed over one or a plurality of print bands after the cooling time was set.

6. The recording apparatus as defined in claim 2, wherein the print control means shortens the print bands for each of which the cooling time is set, when the temperature of the print head exceeds the second temperature or a predetermined third temperature at a time point when printing has been performed over one or a plurality of print bands after the cooling time was set.

7. The recording apparatus as defined in claim 2, wherein the print control means cancels the cooling time to thereafter cause printing according to a printing method that was used prior to detection of the first temperature, when the temperature of the print head becomes lower than the first temperature during or after completion of printing of a print band after detection of the second temperature; and increases the cooling time or shortens the print bands for each of which the cooling time is set, when the temperature of the print head exceeds the second temperature or a predetermined third temperature at a time point when printing has been performed over one or a plurality of print bands after the cooling time was set.

8. The recording apparatus as defined in claim 1, wherein the print head forms print dots according to an ink-jet scheme in which ink is jetted to the recording medium by heat.

9. A recording method for controlling formation of print dots on a recording medium by a print head in accordance with an image to be printed while controlling movement of the print head, each page of the recording medium including a plurality of bands, comprising the steps of:

measuring a temperature increase time in which a temperature of the print head increases from a first temperature to a second temperature;

calculating print density from at least the temperature increase time; and determining a cooling time for each band of the plurality of bands based on at least one of the print density and the temperature increase time.

10. The recording control method as defined in claim 9, further comprising the steps of:

setting the cooling time for each of print bands after detection of the second temperature;

suspending print dot formation by the print head and movement of the print head during the cooling time; and resuming the print dot formation by the print head and the movement of the print head after a lapse of the cooling time.

11. The recording control method as defined in claim 10, wherein in the step of suspending the movement of the print head, the print head is stopped immediately after completion of printing of each of the print bands irrespective of a position of the print head.

12. The recording control apparatus as defined in claim 10, further comprising the step of canceling the cooling time to thereafter cause printing according to a printing method that was used prior to detection of the first temperature, when the temperature of the print head becomes lower than the first temperature during or after completion of printing of a print band after detection of the second temperature.

13. The recording control apparatus as defined in claim 10, further comprising the step of increasing the cooling time, when the temperature of the print head exceeds the second temperature or a predetermined third temperature at a time point when printing has been performed over one or a plurality of print bands after the cooling time was set.

14. The recording control method as defined in claim 10, further comprising the step of shortening the print bands for each of which the cooling time is set, when the temperature of the print head exceeds the second temperature or a predetermined third temperature at a time point when printing has been performed over one or a plurality of print bands after the cooling time was set.

15. The recording control method as defined in claim 10, further comprising the steps of:

canceling the cooling time to thereafter cause printing according to a printing method that was used prior to detection of the first temperature, when the temperature of the print head becomes lower than the first temperature during or after completion of printing of a print band after detection of the second temperature; and increasing the cooling time or shortening the print bands for each of which the cooling time is set, when the temperature of the print head exceeds the second temperature or a predetermined third temperature at a time point when printing has been performed over one or a plurality of print bands after the cooling time was set.

16. The method according to claim 9, further including the step of detecting an environment temperature with an environment temperature detecting means.

17. The method according to claim 16, wherein the step of calculating print density includes calculating print density from the temperature increase time and the environment temperature detected by the environment temperature detecting means.

18. The method according to claim 17, wherein the step of determining a cooling time includes determining a cooling time based on the print density for the environment temperature detected by the environment temperature detecting means.

* * * * *